US005482483A

United States Patent [19]

Rice

[11] Patent Number: 5,482,483

[45] Date of Patent: Jan. 9, 1996

[54] DR. FLUSH (PORTABLE MARINE ENGINE FLUSH SYSTEM)

[76] Inventor: George D. Rice, 93 Cross Creek Cir., Statesboro, Ga. 30458

[21] Appl. No.: 324,691

[22] Filed: Oct. 18, 1994

[51] Int. Cl.[6] ..... B63H 20/30

[52] U.S. Cl. ..... 440/88; 440/113

[58] Field of Search ..... 440/88, 113; 15/264; 4/617; 134/166 R, 167 R; 220/755

[56] References Cited

U.S. PATENT DOCUMENTS

| | | | |
|---|---|---|---|
| 1,719,696 | 1/1929 | Gillespie | 4/617 |
| 2,266,288 | 12/1941 | Thompson | 134/167 R |
| 3,730,382 | 5/1973 | Heisler | 220/755 |
| 4,108,190 | 8/1978 | Carlson | 440/88 |

FOREIGN PATENT DOCUMENTS

| | | | |
|---|---|---|---|
| 0813882 | 9/1951 | Germany | 4/617 |

*Primary Examiner*—Sherman Basinger

[57] ABSTRACT

A portable flushing device for a marine engine, which comprises a reservoir for temporary water storage and a delivery system to the marine engine. The power source for this system is gravity, which allows it to be portable.

1 Claim, 1 Drawing Sheet

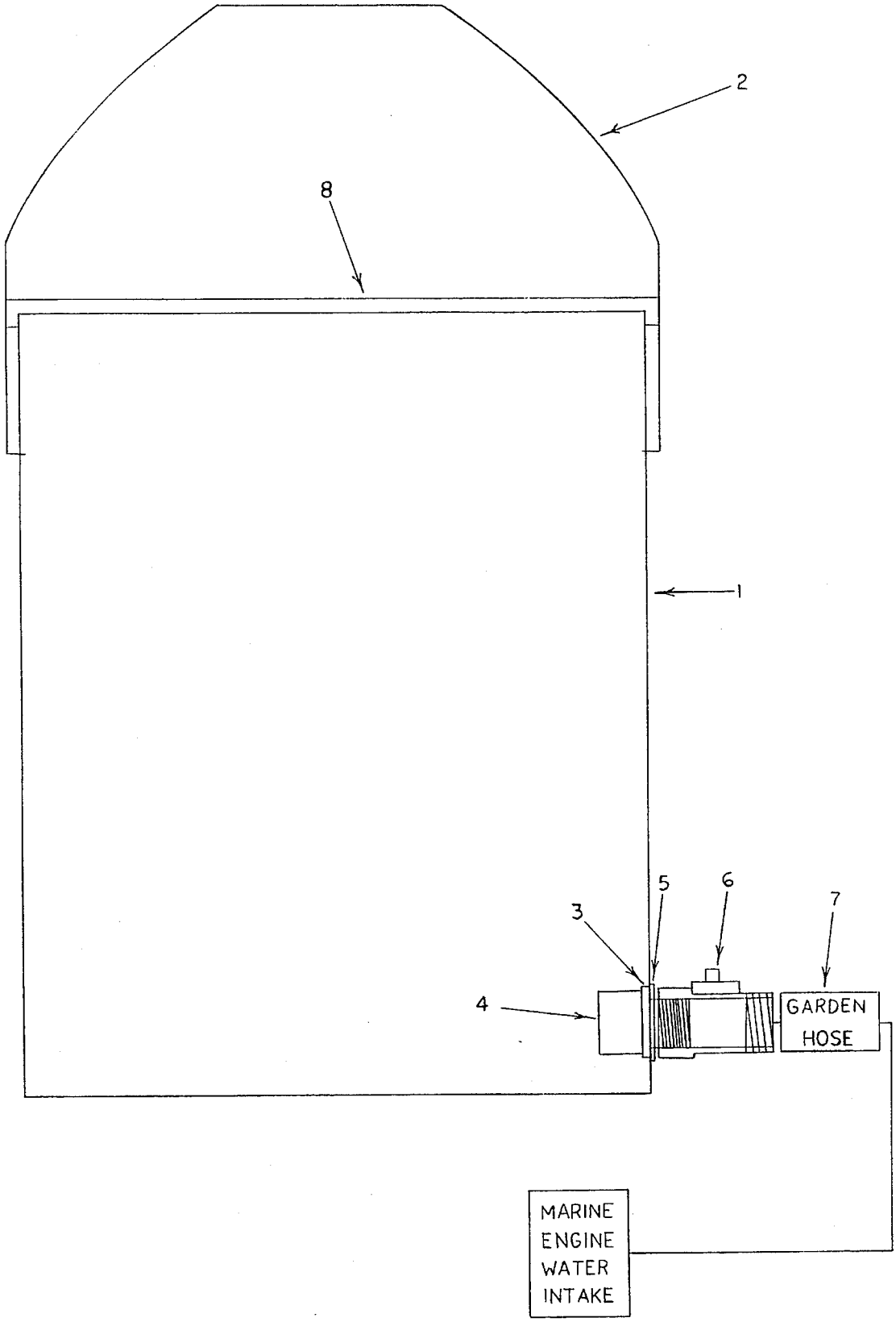
2
8
1
5
6
7
3
4
GARDEN
HOSE
MARINE
ENGINE
WATER
INTAKE

DR. FLUSH (PORTABLE MARINE ENGINE FLUSH SYSTEM)

BRIEF SUMMARY OF THE INVENTION

This apparatus comprises a portable means of flushing marine engines. Until now marine engines have depended on pump pressured water to supply the engine's water pump during operation unless the lower unit was submerged. This system delivers water by means of gravity and a temporary storage reservoir which makes it portable.

BRIEF DESCRIPTION OF THE VIEW OF THE DRAWING

There is one view of the portable flush system. This is a side view which illustrates the reservoir and the water delivery system.

DETAILED DESCRIPTION

A. Production

A five gallon reservoir 1 with handle 2 is obtained. A hole 3 is drilled in the side of the five gallon reservoir 1 1"0 in diameter with the center approximately 1-¼" above the bottom of the reservoir 1. A ¾"×1/2 male adaptor 4 is inserted through the reservoir 1 and tightened to the wall of the reservoir 1 with a ¾" locknut 5. Silicone glue is used to prevent leakage. Teflon tape is applied to the outside threads of the adaptor 4 on the outside of the reservoir 1. A shut-off valve 6 is threaded onto the adaptor 4 and tightened. A 5' to 8' long ⅝" garden hose 7 is included that can be threaded onto the shut-off valve 6. This transports water from the reservoir 1 to a commercially produced motor flush unit that attaches to the water intake at the lower unit of the marine engine. A lid 8 is placed on the five gallon reservoir 1 during transportation when filled with water.

B. Operation

As stated earlier, this unit is portable due to the fact that gravity is the power source. It does not rely on electricity or external sources of water pressure to operate. It relies on gravity flow to force the water into the impeller of the water pump of the marine engine. Also, water is transported in the reservoir to the location of the engine. Initially, the shut-off valve is closed and the reservoir is filled with fresh water. The lid is then put snugly on the reservoir and the reservoir is transported to the location of the marine engine. The reservoir is then placed on a flat surface substantially higher than the water pump of the engine. One end of the ⅝ garden hose is screwed onto the shut-off valve of the reservoir and the other end is screwed onto the flush unit that has already been placed over the water intake of the lower unit of the marine engine. The lid is removed from the reservoir and the shut-off valve is opened allowing water to flow freely to the flush unit on the marine engine. The engine is cranked and allowed to run at idle speed until the reservoir is drained of water.

Due to the portability of this system, the life of many marine engines may be prolonged. In salt water operation, corrosion may severely limit the life of a marine engine. By flushing the marine engine immediately with fresh water after the engine is removed from salt water, much of the corrosion can be prevented. Prevention of corrosion is much more economical than trying to replace corroded parts.

Many marine engines are stored in remote locations that do not have a source of water. Therefore, the engines are not cranked frequently which can cause inadequate lubrication of internal parts. By using this portable system, the engine can be operated more frequently, and this will allow lubrication of the internal parts.

Finally, many marine engines may require additional care by flushing with other chemicals. Chemicals can easily be added directly to the five gallon reservoir for flushing. Chemicals may be needed to assist with winterizing a marine engine or to alleviate algae problems, etc. This is a very portable and effective means of flushing marine engines.

I claim:

1. A method for flushing a portable marine engine having an intake and a pump, said method comprising:

a. providing a reservoir with a handle and lid to act as a temporary storage reservoir for a flushing liquid;

b. providing a hole in a lower side wall of the reservoir;

c. inserting a male adaptor in the hole provided in the lower side wall of the reservoir;

d. providing a lock nut to hold the adaptor in place;

e. attaching a shutoff valve to the adaptor;

f. providing a hose having first and second ends to transport the flushing liquid to the portable marine engine;

g. closing the shutoff valve;

h. filling the reservoir with the flushing liquid;

i. placing the lid on the reservoir;

j. placing the reservoir which has been filled with the flushing liquid near the marine engine and higher than the pump of the marine engine;

k. attaching the first end of the hose to the adaptor;

l. attaching the second end of the hose to the intake of the marine engine; and m. removing the lid and opening the shutoff valve to let the liquid flow freely to the marine engine so as to flush the marine engine.

* * * * *